US005786539A

United States Patent [19]

Steinberger

[11] Patent Number: 5,786,539

[45] Date of Patent: Jul. 28, 1998

[54] NECK JOINT FOR STRINGED MUSICAL INSTRUMENT

[76] Inventor: Richard Ned Steinberger, HC 64 Box 090B, Walpole, Me. 04573

[21] Appl. No.: 585,456

[22] Filed: Jan. 16, 1996

[51] Int. Cl.[6] ..... G10D 3/00

[52] U.S. Cl. ..... 84/293; 84/291

[58] Field of Search ..... 84/293, 291

[56] References Cited

U.S. PATENT DOCUMENTS 3,196,730 7/1965 Daniel ..... 84/293
3,678,795 7/1972 Fullerton ..... 84/293
4,856,403 8/1989 Davies ..... 84/291
5,452,637 9/1995 DeCola ..... 84/291

*Primary Examiner*—William M. Shoop, Jr.
*Assistant Examiner*—Marlon T. Fletcher
*Attorney, Agent, or Firm*—Saul Epstein

[57] ABSTRACT

A rigid neck joint for a stringed musical instrument. In one embodiment angled screws urge the neck of the instrument toward a side of the neck recess in the body as well as toward the bottom of the recess. In other embodiments, an angled piece in the neck engages a stop to force the neck against a side of the neck recess as the neck is tightened to the body.

9 Claims, 3 Drawing Sheets

NECK JOINT FOR STRINGED MUSICAL INSTRUMENT

BACKGROUND OF THE INVENTION

This invention relates to neck joints for stringed musical instruments, especially guitars. In particular, the invention is directed to means for fastening the neck to the body of the instrument so that the joint is rigid.

There are three general kinds of neck joints used in necked musical instruments.

"Neck-through" instruments have a neck which extends competely through the instrument, and are almost always permanently glued in.

"Set-neck" instruments have a neck which is permanently glued in, with a tenon or dovetail joint where the body meets the neck. These instruments usually have a neck heel just forward of the body which extends down to the back of the body.

"Bolt-on" instruments have an opening in the body where the neck overlaps the body, and are bolted onto the body so that the neck can be removed.

Acoustic guitars are traditionally set-neck instruments, with a neck heel just forward of the body and extending down to the back of the body. This forward protrusion of the neck at the body restricts access to the highest region of the fingerboard.

Common bolt-on instruments are economical to construct and repair. The drawbacks of existing bolt-on designs are that the joint has less side-to-side rigidity than glued in necks, and access to the highest region of the fingerboard, near the body, is restricted by the body portion extending under the overlap of the neck.

SUMMARY OF THE INVENTION

The present invention overcomes the side-to-side instability of existing bolt-on necks by applying pressure simultaneously against fixed horizontal and vertical surfaces on the body, making a rigid joint in all directions.

In one embodiment, applicable particularly to electric guitars which have a solid body, angled screws are used to force the neck against the body in both the up-and-down and side-to-side directions simultaneously. The angled screws force the neck against the non-cut-away side of the body. This allows the opposite side, where the left hand reaches to play the higher frets, to be cut away more than on conventional designs, exposing more of the neck and improving access to the higher region of the fingerboard.

In a second embodiment of the invention, the neck is held to a horizontal surface of the body by screws, as in prior art bolt-on designs, but an additional screw through the body presses against an angled plate buried in the neck so as to force the neck against a side of the neck opening in the body.

A third embodiment, applicable particularly to acoustic guitars, again involves angled bolts holding the neck to the guitar body. In this embodiment, however, the angle of the bolts draws the neck toward the back of the instrument, and a screw in the body bears against an angled plate in the neck so as to force the neck against one side of the neck opening in the body. String tension aids the angled bolts in drawing the neck toward the back of the instrument.

DETAILED DESCRIPTION OF THE INVENTION

Figure 3:
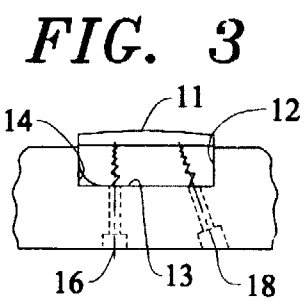
FIG. 3 is a cross sectional view taken at 3—3 of FIG. 2.
Figure 2:
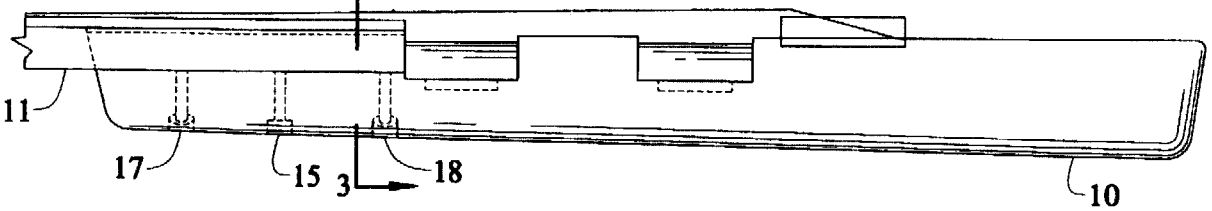
FIG. 2 is a side view of the guitar of FIG. 1.
Figure 1:
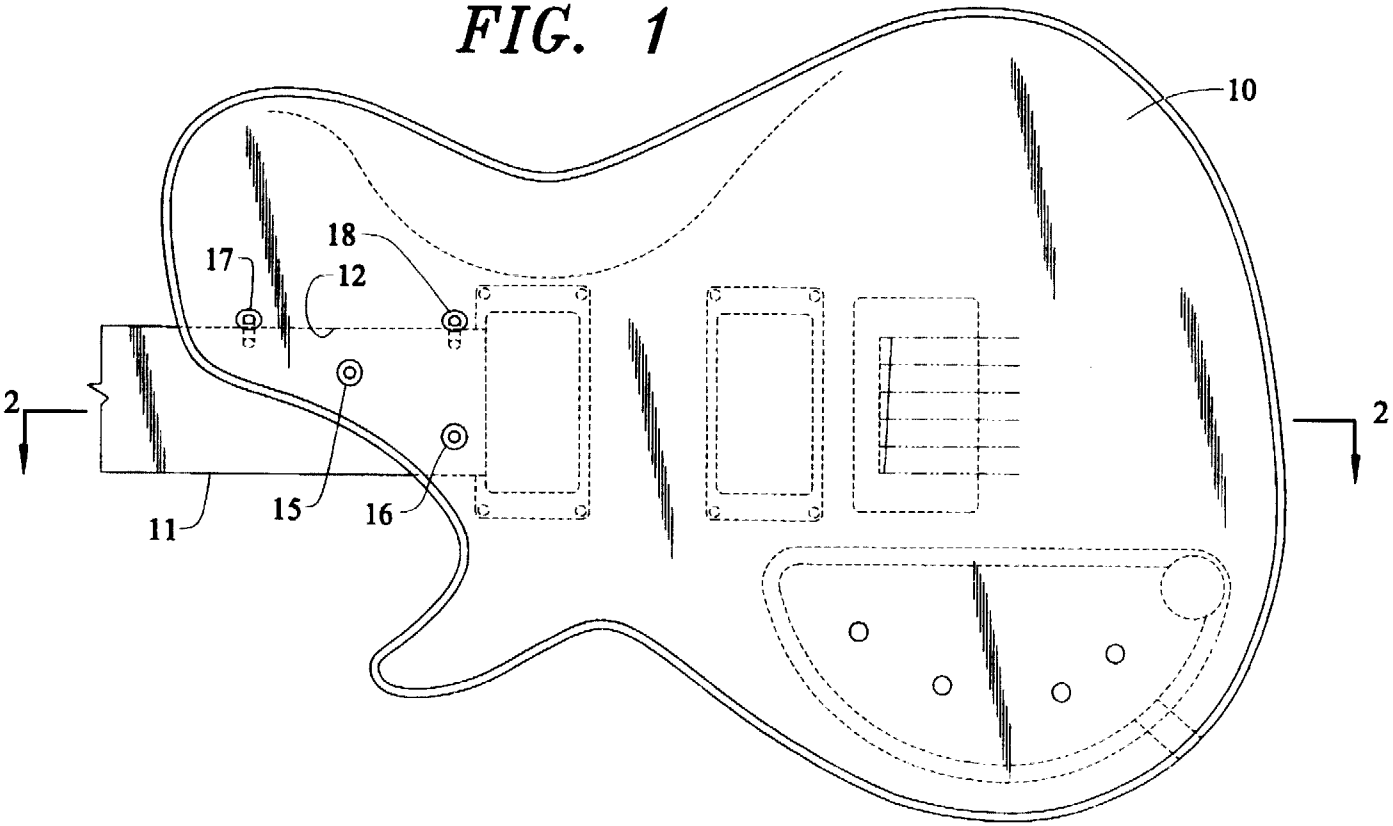
FIG. 1 is a bottom plan view of a guitar embodying the present invention.

A first embodiment of the invention is illustrated in FIGS. 1–3. A solid body electric guitar is illustrated which has a body 10 and a neck 11. A rectangular recess in the body top, designated by numerals 12, 13, and 14, is provided to receive the neck 11. The neck is fastened to the body by screws 15, 16, 17, and 18. Screws 15 and 16 are made normal to the surface 13 while screws 17 and 18 are angled so that when they are tightened, the neck 11 is forced against surface 12 in the body, as well as surface 13. By forcing the neck against surface 12, the rigidity of the joint between the neck and body is increased substantially as compared to the prior art type of joint wherein all of the fastening screws tighten the neck against the bottom surface of the neck opening in the body. Since the neck is forced against surface 12, the guitar body can be severely cut away on the opposite side (as can be seen in FIG. 1) to give better access to the higher region of the fingerboard without causing any weakening of the neck/body joint.

Figure 4:
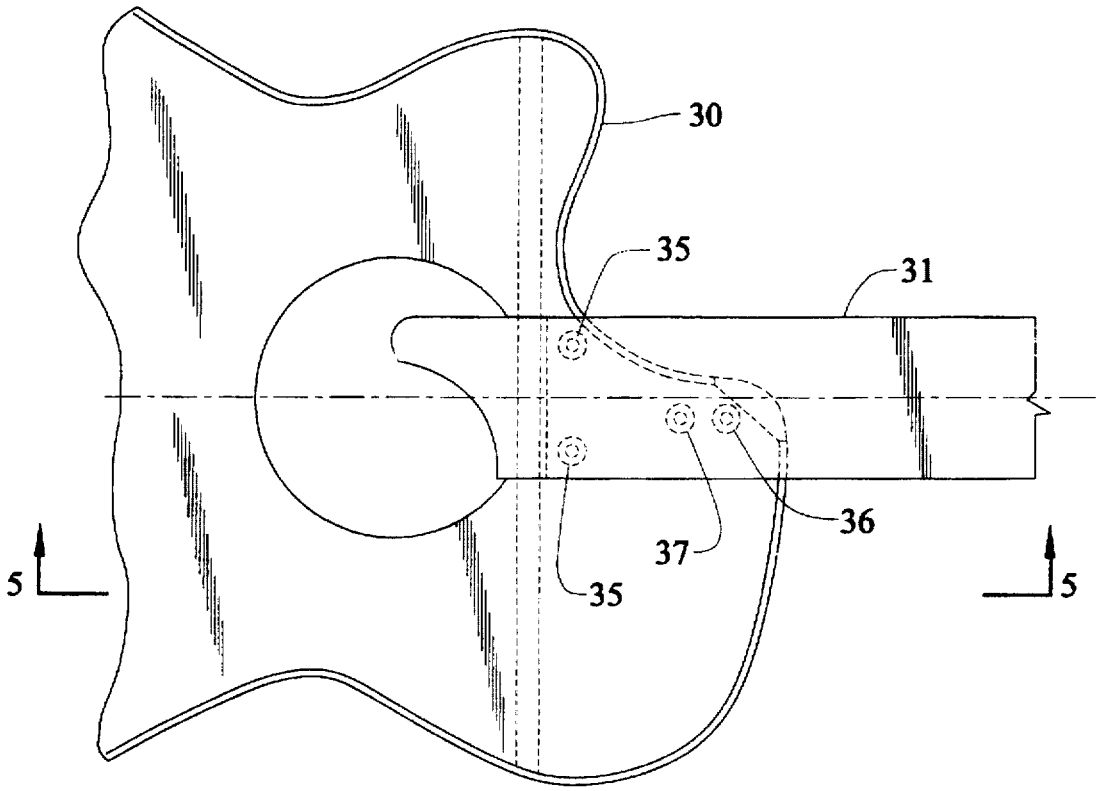
FIG. 4 is a plan view of a second embodiment of a guitar embodying the present invention.
Figure 5:
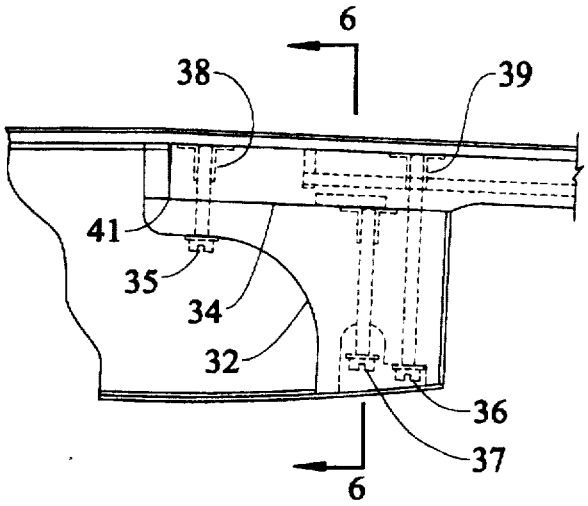
FIG. 5 is a cross sectional view taken at 5—5 of FIG. 4.
Figure 6:
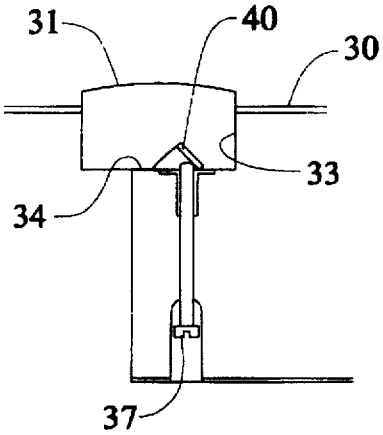
FIG. 6 is a cross sectional view taken at 6—6 of FIG. 5.
Figure 7:
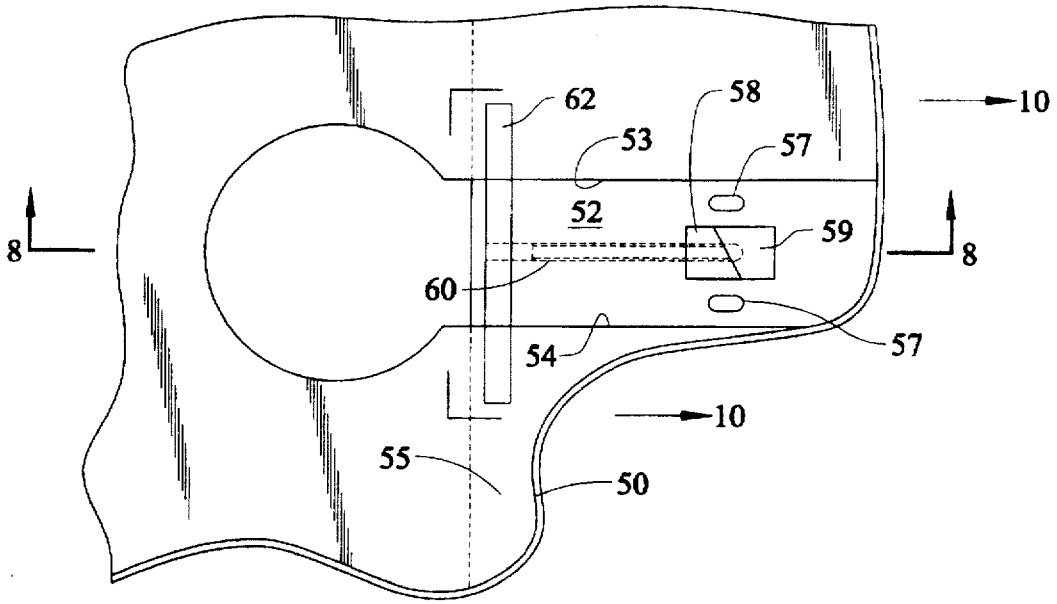
FIG. 7 is a plan view of a third embodiment of a guitar embodying the present invention. The neck has been omitted for clarity.
Figure 8:
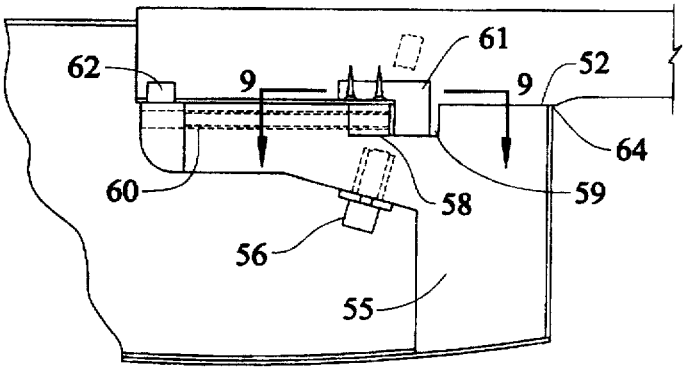
FIG. 8 is a cross sectional view taken at 8—8 of FIG. 7, with the neck in place.
Figure 9:
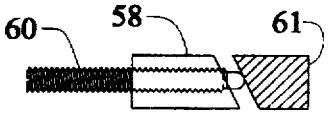
FIG. 9 is a cross sectional view taken at 9—9 of FIG. 8.

A second embodiment of the invention is illustrated in FIGS. 4–6. An acoustic guitar is illustrated having a body 30 to which a neck 31 is attached. A block 32 at the front of the body includes an "L" shaped opening (having surfaces 33 and 34) for receiving the neck. Screws 35 and 36, threaded into "T" nuts 38 and 39 draw the neck to surface 34. A plate 40 (preferably made of metal) is set into neck 31 on an angle, and engages screw 37. As screws 35 and 36 draw the neck toward surface 34, the action of screw 37 against the angled plate 40 forces the neck against surface 33, substantially increasing the rigidity of the joint. It will be appreciated that an equivalent structure can be made wherein the positions of the angled plate 40 and screw 37 are reversed, i.e., the angled plate inset in the body, and the screw passing through the neck. As in the first embodiment, the side of the body opposite the surface 33 can be cut away severely to provide access to the higher region of the fingerboard.

As assembled, screws 35 bring the back portion of the neck into contact with surface 34, however, a gap exists between the neck and surface 32 at the location of screw 36. The amount of this gap can be changed by adjustment of the screw 37. Such adjustment changes the angular position of the neck with respect to the body. Preferably the bottom of the neck is relieved slightly behind screws 35 so that the neck pivots about the location of screws 35, instead of at the heel of the neck 41. Changing the angular position of the neck with respect to the body causes the spacing between the strings and the neck to change, and hence adjusts the action of the instrument.

A final embodiment of the invention is illustrated in FIGS. 7–10. This embodiment also is illustrated in connection with with an acoustic guitar. A body 50 is shown, to which is attached a neck 51. A block 55 at the front of the body includes a rectangular recess comprised of surfaces 52, 53, and 54 for receiving the neck. The neck is held to the block 55 by a pair of angled bolts 56 which pass through slots 57 in the block and are threaded into the neck 51. T-nuts or similar hardware (not shown) is preferably used in the neck to receive the threaded ends of bolts 56. Since the bolts 56 are angled, tightening them urges the neck towards the back of the body.

A rectangular nut 58 is located in a recess 59 in the block 55. Screw 60 is threaded through nut 58, and bears against angled block 61, which is attached to the neck 51. The interaction between angled block 61 and screw 60 is illustrated in the fragmentary view shown in FIG. 9. As the neck is drawn toward the back of the guitar by the action of bolts 56, angled block 61 bears against screw 60, forcing the neck against surface 53. String tension aids bolts 56 in forcing the neck toward the back of the instrument, and thereby toward surface 53.

Positioning screw 60 provides an adjustment for intonation. It may be noted that the nut 58, even though its face does not contact angle block 61, has an angled face. This angle is preferred since it reduces the exposed length of screw 60 and so reduces the tendency of screw 60 to bend.

Figure 10A:
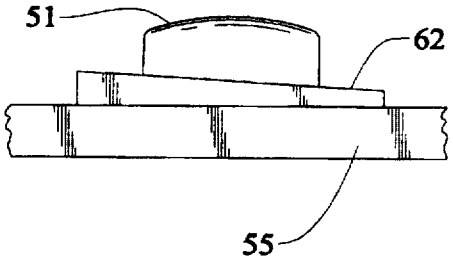
FIGS. 10A and 10B are fragmentary sections showing two alternate ways of adjusting the action in the instrument illustrated in FIGS. 7–9, taken at 10—10 of FIG. 7.
Figure 10B:
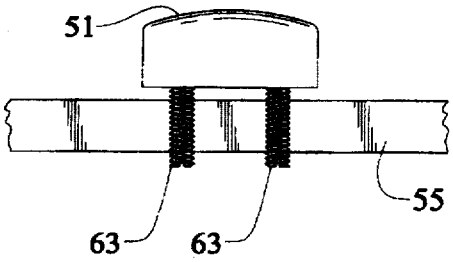

Action adjustment in this instrument is provided by positioning the wedge 62 (illustrated in FIG. 10A) as desired transversely to the neck. Alternatively, screw adjstments 63, as illustrated in FIG. 10B, can be used to provide action adjustment, in place of wedge 62. In either case, the neck pivots around the front edge 64 of the instrument as the action is adjusted.

I claim:

1. A neck joint for a stringed musical instrument which comprises:

a body having a recess to receive a neck, said recess having a bottom surface and at least one side surface, said at least one side surface being substantially parallel to the long axis of said neck;

a neck having a long axis in said recess, said neck including a fingerboard having a higher region adjacent said body; and bolting means for securing said neck to said body, including bolting means having an axis inclined with respect to said bottom surface and said at least one side surface of said recess whereby said neck will be urged against said bottom surface and said at least one side surface of said recess as said bolting means are tightened.

2. A neck joint for a stringed musical instrument as recited in claim 1 wherein said body is cut away in the region of said recess on the side of said recess opposite said at least one one side surface whereby access to said higher region of said fingerboard is provided.

3. A neck joint for a stringed musical instrument which comprises:

a body having a recess to receive a neck, said recess having a bottom and at least one side surface substantially parallel to the the long axis of said neck;

a neck having a long axis in said recess, said neck including a fingerboard having a higher region adjacent said body;

angled means attached to said neck, said angled means making an acute angle with respect to said at least one side surface;

means attached to said body for engaging said angled means; and bolting means for bolting said neck to said body, said bolting means causing said means for engaging said angled means to exert force against said angled means when said bolting means are tightened whereby said neck will be forced against said at least one side surface of said recess.

4. A neck joint for a stringed musical instrument as recited in claim 3 wherein said means for engaging said angled means is a screw passing through said body.

5. A neck joint for a stringed musical instrument as recited in claim 3, and further including adjustable wedge means acting between said neck and said body for adjusting the angle between said neck and said body.

6. A neck joint for a stringed musical instrument as recited in claim 3, and further including screw means acting between said neck and said body for adjusting the angle between said neck and said body.

7. A neck joint for a stringed musical instrument as recited in claim 3, where said angled means is angled with respect to said long axis of said neck.

8. A neck joint for a stringed musical instrument as recited in claim 7 wherein said means for engaging said angled means is a screw substantially parallel to said long axis of said neck whereby adjustment of said screw will adjust the intonation of said instrument.

9. A neck joint for a stringed musical instrument as recited in claim 3 whereby said body is cut away in the region of said recess on the side of said recess opposite said at least one side surface whereby access to said higher of said fingerboard is provided.

* * * * *